US005230551A

United States Patent [19]

Kramer

[11] Patent Number: 5,230,551

[45] Date of Patent: Jul. 27, 1993

[54] CONCEALED CASE CHEST OF DRAWERS

[76] Inventor: Peter H. Kramer, Gay and Jette Sts., P.O. Box 232, Washington, Va. 22747

[21] Appl. No.: 753,750

[22] Filed: Sep. 3, 1991

[51] Int. Cl.[5] ..... A47B 88/04

[52] U.S. Cl. ..... 312/204; 312/348.4

[58] Field of Search ..... 312/204, 330.1, 348.4, 312/348.1, 341.1, 205

[56] References Cited

U.S. PATENT DOCUMENTS 970,970 9/1910 Tennent ..... 312/330.1 X 1,120,955 12/1914 Martin ..... 312/205

3,024,075 3/1962 Howe ..... 312/348.1

3,895,733 7/1975 Chambers ..... 312/330.1 X

*Primary Examiner*—Peter R. Brown

*Attorney, Agent, or Firm*—Allegretti & Witcoff, Ltd.

[57] ABSTRACT

A concealed chest of drawers allows for the shaping of its exterior. The concealed case chest of drawers is comprised of a frame and a drawer which is slidably connected to the frame. The drawer is further comprised of a plurality of decor panels made in almost any shape and size according to the desired shape of the concealed case chest of drawers.

14 Claims, 3 Drawing Sheets

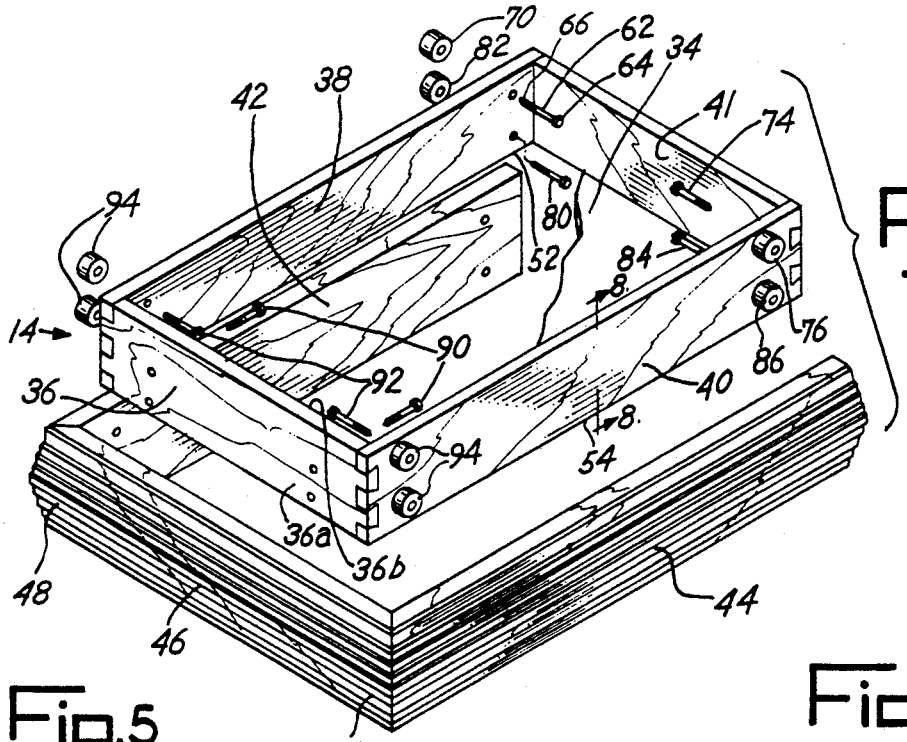
Fig.4
Fig.5
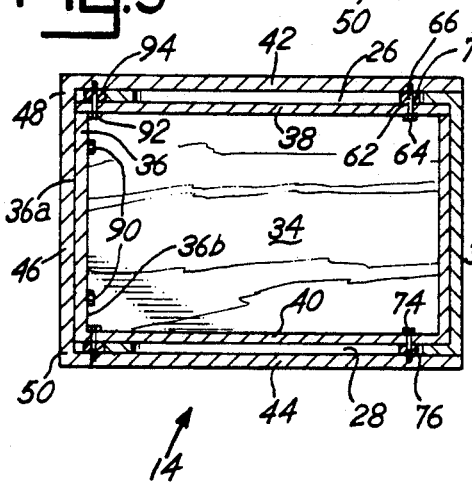
Fig.6
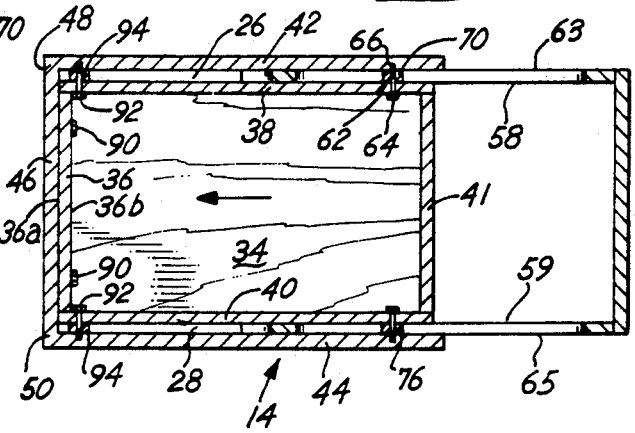
Fig.7
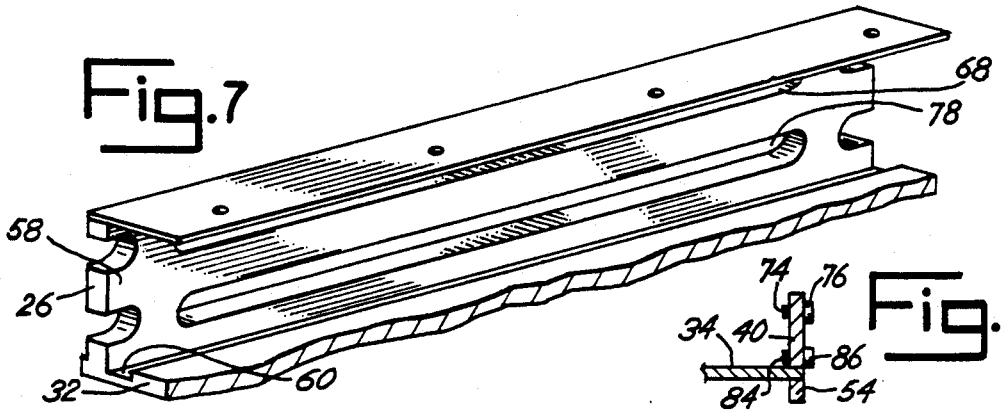
Fig.8

CONCEALED CASE CHEST OF DRAWERS

BACKGROUND OF THE INVENTION

The present invention relates to concealed case chest of drawers. More particularly, the present invention relates to a chest of drawers, whose exterior can be shaped in a multitude of ways, while maintaining the functionality of the drawers.

Currently, furniture containing a drawer or set drawers, has a box-like appearance. This is because the mechanics of mounting or slidably attaching a drawer within a frame limits the configuration of the exterior shape of the chest of drawers. In other words, as far as shapes are concerned, if you have seen one set of drawers, you have seen them all. However, the present invention permits a chest of drawers to have an infinite number of exterior shapes. The present invention is useful to interior designers and other who may wish to vary the shape of a chest of drawers.

Accordingly, the primary object of the invention is to provide a concealed case chest of drawers which allows for shaping of its exterior in a way unattainable by presently available chests.

Further objects and advantages of the present invention will become apparent in the following description.

SUMMARY OF THE INVENTION

The present invention provides a concealed case chest of drawers useful in interior design. The concealed case chest of drawers described herein is particularly useful to anybody who desires to have different shapes on the exterior of a drawer or set of drawers. The concealed case chest of drawers is comprised of a frame and at least one drawer which is slidably connected to the frame. The frame is comprised of a first side wall, a second side wall, a top, and a back wall. The drawer is comprised of a bottom panel, a front panel, a first side panel, a second side panel, a first decor side panel and a second decor side panel. The front panel has both a front and a back surface. Both of the side panels are connected to the drawer such that they extend horizontally between the first side wall and the second side wall of the frame. The decor side panels extend horizontally outside the frame on either side of the frame's first side wall and second side wall. Essentially, the shaping of the first decor side panel and the second decor side panel help determine the exterior shape of the concealed case chest of drawers.

DETAILED DESCRIPTION OF THE DRAWINGS

For a better understanding of the invention, reference may be had to the following description taken in conjunction with the accompanying drawings, wherein:

FIG. 4 is a perspective exploded view of a drawer;

FIG. 4*a* is a partial perspective exploded view of a drawer having a lip portion;

FIG. 5 is a cross sectional view of a drawer in the closed position in the frame;

FIG. 6 is a cross sectional view of a partially open drawer;

FIG. 7 is an enlarged view of a portion of a side wall of a frame and a portion of a connecting means; and FIG. 8 is a cross sectional view of a portion of a drawer taken generally along line 8—8 of FIG. 4.

DETAILED DESCRIPTION OF THE PREFERRED EMBODIMENT

Figure 1:
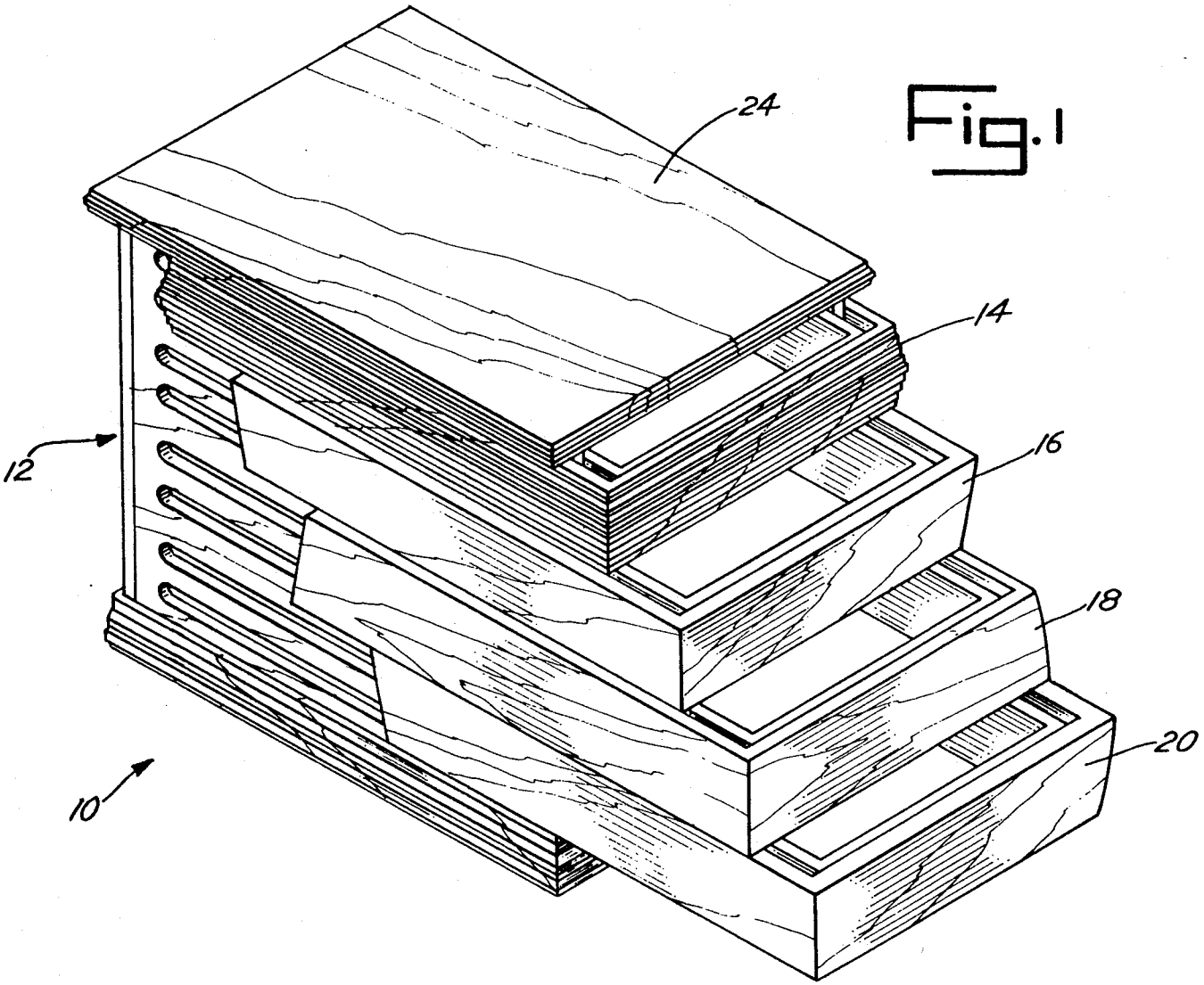
FIG. 1 is a perspective view of the concealed case chest of drawers in the open position.

Referring initially to FIG. 1, the concealed case chest of drawers 10 is comprised of a frame 12 (see FIG. 3) and a plurality of drawers 14, 16, 18, and 20. For purposes of brevity, further references to "drawers" may only describe a single drawer, although those skilled in the art know that any number of drawers can be used in a chest.

Figure 2:
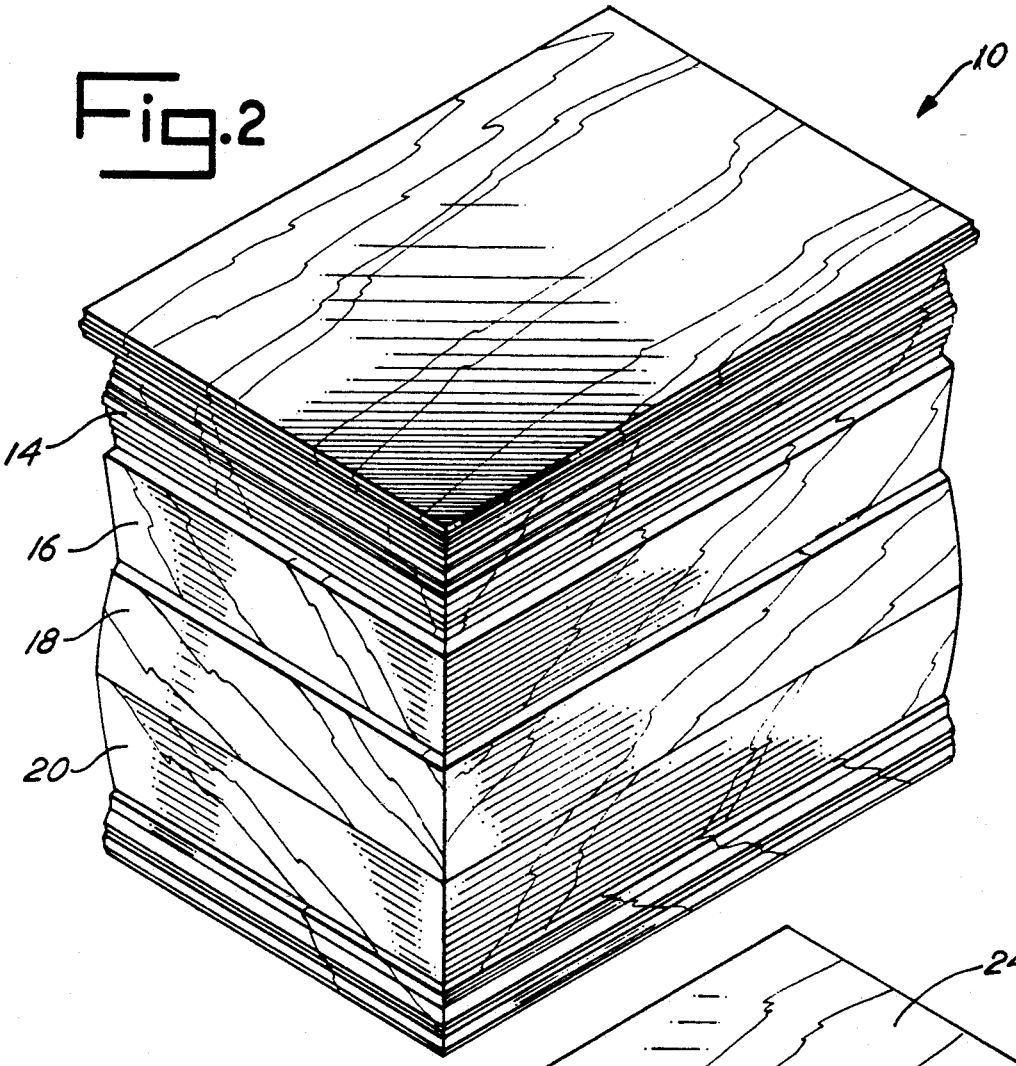
FIG. 2 is a perspective view of the concealed case chest of drawers in the closed position.

Referring to FIG. 2, the concealed case chest of drawers 10 is shown with all the drawers, 14, 16, 18, and 20, in the closed position. Decor panels are affixed to the exterior surfaces of the drawers and help to shape the exterior of the concealed case chest of drawers 10 as desired, without interfering with the function of the concealed case chest of drawers 10. The decor panels may be flat or contoured, with a design thereon. The way in which the concealed case chest of drawers 10 functions, while allowing for a multitude of exterior shapes, can best be understood from an explanation of the remaining figures.

Figure 3:
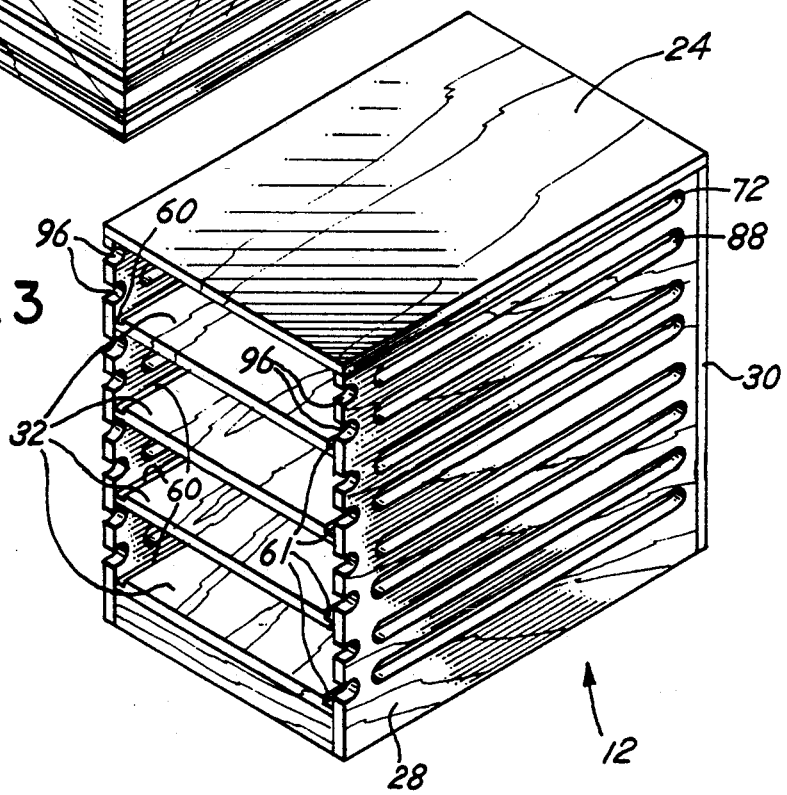
FIG. 3 is a perspective view of the frame of the chest of drawers of FIG. 1 and FIG. 2.

Referring to FIG. 3, the frame 12 is comprised of a top 24, a first side wall 26, a second side wall 28, and a back wall 30 integrally joined by fastening means, e.g., an adhesive. The frame 12 may also have a bottom (not shown), although it is not necessary. Connecting means 32, in the form of horizontally disposed panels, are affixed to the back wall 30 and the side walls, 26 and 28, of the frame 12.

Referring to FIG. 4, a drawer 14 is shown in its exploded view. The drawer 14 is comprised of a bottom panel 34 (shown only in part), a front panel 36, a first side panel 38, a second side panel 40, a back panel 41, a first decor side panel 42, and a second decor side panel 44. The panels 36, 38, 40, and 41 may be connected by tongue and groove means as shown. The front panel 36 has a front surface 36*a* and a back surface 36*b*. The bottom panel 34 has a first edge (not shown) fixedly attached to the first side panel 38 and a second edge (not shown) fixedly attached to the second side panel 40. The drawer 14 also has an decor front panel 46 which has a first end 48 and a second end 50. The first decor side panel 42 is attached to the decor front panel 46 at its first end 48. The second decor side panel 44 is attached to the second end 50 of the decor front panel 46. A lower edge 52 of the first side panel 38 and a corresponding lower edge 54 of the second side panel 40 extend below the bottom panel 34 of the drawer 14 (see FIG. 8).

Referring to FIGS. 5 and 6, the drawer 14 is shown in its closed position and its open position in the frame 12, respectively. The front panel 36, first side panel 38, second side panel 40, first decor side panel 42, and second decor side panel 44 are operatively connected. The first decor side panel 42 is attached to the decor front panel 46 at its first end 48 by suitable fastening means, e.g., an adhesive. The second decor side panel 44 is attached to the second end 50 of the decor front panel 46 by suitable fastening means, e.g., an adhesive.

Referring to FIG. 7, a portion of the first side wall 26 of the frame 12 for receiving a drawer 14 is shown.

Each connecting means, generally designated by the number 32, is fixedly attached to an inner surface 58 (see FIG. 6) of the first side wall 26 of the frame 12 and to an inner surface 59 (see FIG. 6) of the second side wall 28 of the frame 12 and has a first horizontal groove 60 near the inner surface 58 of the first side wall 26. The connecting means 32 has a second horizontal groove 61 in close proximity to inner surface 59 (see FIG. 6) of the second side wall 28 of the frame 12 (see FIG. 3). The first side wall 26 and the second side wall 28 have outer surfaces 63 and 65, respectively (see FIG. 6). The connecting means 32 may comprise a panel as shown in FIG. 3 or alternatively may take the form of strips having a first horizontal groove 60 and a second horizontal groove 61 (see FIG. 3) parallel to the inner surfaces, 58 and 59, of the first side wall 26 and the second side wall 28, respectively.

The drawer is placed into the frame 12 in a manner in which the lower edge 52 (see FIG. 4) of the first side panel 38 slidably engages with the first horizontal groove 60 of the connecting means 32. Similarly, a lower edge 54 (see FIG. 4) of the second side panel 40 slidably engages with the second horizontal groove 61. The drawer 14 is thereby slidably supported for movement into and out of the frame 12.

Referring to FIGS. 4 and 7, the interconnection of the drawer 14 to the frame 12 will be made more evident. The first decor side panel 42, the second decor side panel 44, and the decor front panel 46 are connected to the first side panel 38, the second side panel 40, and the front panel 36 of the drawer 14, respectively. A first connecting rod 62 has a first end 64 and second end 66, the first end 64 being fixedly attached to the first side panel 38. The first connecting rod 60 passes through a horizontal slot 68 (see FIG. 7) in the first side wall 26 of the frame 12. The second end 66 is connected to the first decor side panel 42. The first connecting rod 62 is surrounded length-wise by a first cylindrical spacer 70 (see FIGS. 4 and 5). The first cylindrical spacer 70 has a diameter smaller than the height of the horizontal slot 68 of the first side wall 26. The first cylindrical spacer 70 is rotatably mounted on the first connecting rod 62. The length of the first connecting rod 62 and the first cylindrical spacer 70 determine how far the first decor side panel 42 is offset from the first side panel 38. Further, the first cylindrical spacer 62 rolls along the horizontal slot 68 of the first side wall 26 when the drawer 14 is pushed into or out of the frame 12. Thus, the first cylindrical spacer 70 facilitates movement of the drawer 14 into and out of the frame 12. The second side wall 28 also has a horizontal slot 72 (see FIG. 3). The second side panel 40 is connected to the second decor side panel 44 with a second connecting rod 74 and second cylindrical spacer 76 in the same manner as described for the connection between the first side panel 38 and the first decor side panel 42. Therefore, when the concealed case chest of drawers 10 is fully assembled, the first side wall 26 is between the first side panel 38 and the first decor side panel 42 and the second side wall 28 is between the second side panel 40 and the second decor side panel 44 (see FIG. 4). In its preferred embodiment, for each drawer 14 the first side wall 26 contains two horizontal slots, 68 and 78 (see FIG. 7). The first side panel 38 is connected to the first decor side panel 42 by using two connecting rods (62 and 80 of FIG. 4) and two cylindrical spacers (70 and 82 of FIG. 4), one connecting rod 62 and one cylindrical spacer 70 for a first horizontal slot 68 (see FIG. 7) and another connecting rod 80 and cylindrical spacer 82 for a second horizontal slot 78 (see FIG. 7). Also, the second side wall 28 has two horizontal slots and (see FIG. 2) for each drawer. The second side panel 40 is connected to the second decor side panel 44 by using two connecting rods (74 and 84 of FIG. 4) and two cylindrical spacers (76 and 86 of FIG. 4), one connecting rod 74 and one cylindrical spacer 76 passing through one horizontal slot 72 (see FIG.3) and another connecting rod 84 and cylindrical spacer 86 passing through a second horizontal slot 88 (see FIG. 3). Further, in its preferred form, the invention uses four bolts (only the upper two being shown as 90 of FIG. 4) to connect the front panel 36 to the decor front panel 46.

Further, referring to FIG. 4, in its preferred form, the first side panel 38 and the second side panel 40 are connected to the first decor side panel 42 and the second decor side panel 44, respectively, with four connecting rods each (only two of which are shown as 92 of FIG. 4). Each connecting rod 92 has a corresponding cylindrical spacer 94 which enters a corresponding recess 96 (see FIG. 3) when the drawer is closed.

The invention has been described in detail with particular reference to an concealed case chest of drawers 10 comprised of a frame 12 and a drawer 14. However, those skilled in the art understand that there are numerous variations and modifications of the present invention. For instance, the present invention could have four drawers 14, 16, 18, and 20, as shown, or a lesser or greater number of drawers. Further, the present invention only needs decor panels on those portions of the exterior of the concealed case chest of drawers 10 which the designer would like to shape. Still further, the first side wall 26 and/or the second side wall 28 may have more or less two horizontal slots per drawer while achieving the same function in substantially the same way to obtain the same result. Additionally, two drawers can be placed side by side while still permitting the designer to shape the exterior of the concealed case chest of drawers 10. In this case, the side by side drawers may move independently. On the other hand, the side by side drawers may also be the same drawer 10 split into two compartments by a first side wall 26 which is no longer attached to the top 24 at an end of the top but is instead attached to a middle area of the top 24. In this configuration, a second side wall 28 is unnecessary. Also, a decor front panel 46 is connected to a front panel 36 of drawer 10. Further, a first decor side panel 42 is attached to the a first end 48 of the decor front panel 46 and a second decor side panel 44 is attached to the second end 50 of the decor front panel 46. Finally, the front panel 36 need not have a decor front panel 46 attached thereto. In this case, the front panel 36 would have at least one a lip portion 98, the lip portion 98 extending beyond the first edge of the bottom panel 34 and the first side wall 26. The first decor side panel 42 is attached to the lip portion 98 of the front panel 36. Similarly, the front panel 36 may have a second lip portion extending beyond the second edge of the bottom panel 34 and the second side wall 28. The second decor side panel 44 is connected to the second lip portion of the front panel 36. While these are some of the variations and modifications which can be made to the present invention, those of ordinary skill in the art understand that other variations and modifications can be effected within the spirit and scope of the invention as described here and above and as defined in the appended claims.

What is claimed is:

1. A concealed case chest of drawers comprising:

(a) a frame, the frame comprised of:

(i) a first side wall, the first side wall having an inner surface and an outer surface;

(ii) a second side wall, the second side wall having an inner surface and an outer surface, the inner surface of the second side wall facing the inner surface of the first side wall; and (iii) a top connecting the first side wall to the second side wall;

(b) a drawer comprised of:

(i) a bottom panel, the bottom panel having a first edge and a second edge, the first edge being in close proximity to the inner surface of the first side wall and the second edge being in close proximity to the inner surface of the second side wall;

(ii) a front panel connected to the bottom panel, the front panel having a front and a back surface, and at least a first lip portion, the first lip portion extending beyond the first edge of the bottom panel and the first side wall;

(iii) a first side panel fixedly attached to the back of the front panel and substantially perpendicular to the front panel, the first side panel extending horizontally between the inner surface of the first side wall and the inner surface of the second side wall and being closer to the inner surface of the first side wall;

(iv) a first decor side panel fixedly attached to the first lip portion of the front panel and substantially perpendicular to the front panel, the first decor panel extending horizontally in closer proximity to the outer surface of the first side wall than the inner surface of the first side wall;

(c) connecting means for slidably connecting the drawer to the frame, the connecting means being attached to and extending outwardly from the inner surfaces of the first side wall and the second side wall;

(d) a first connecting rod having a first end and a second end, the first end attached to the first side panel at a point closer to the inner surface of the first side wall than the outer surface of the first side wall, the second end attached to the first decor side panel at a point closer to the outer surface of the first side wall than the inner surface of the first side wall; and (e) a first cylindrical spacer essentially surrounding the first connecting rod lengthwise, the first cylindrical spacer having a diameter smaller than the height of a horizontal slot in the first side wall and being rotatable with respect to the first connecting rod, whereby the first connecting rod serves to secure the first side panel to the first decor side panel and the first cylindrical spacer serves to help guide the drawer into and out of the frame by its rotational movement along the horizontal slot when the drawer is pulled open or pushed closed.

2. The concealed case chest of drawers of claim 1 further comprised of a second connecting rod, a second side panel of the drawer, a second decor side panel, and a second cylindrical spacer, and also having the second side wall further comprised of an opposing horizontal slot, the opposing horizontal slot being substantially coextensive with the horizontal length of the second side wall, and also having the front panel comprised of a second lip portion, the second lip portion extending beyond the second edge of the bottom panel and the second side wall, the second connecting rod having a first end and a second end, the first end attached to the second side panel at a point closer to the inner surface of the second side wall than the outer surface of the second side wall, the second end attached to the second decor side panel at a point closer to the outer surface of the second side wall than the inner surface of the second side wall, the second decor side panel being fixedly attached to the second lip portion of the front panel, extending horizontally, and being substantially perpendicular to the front panel and in closer proximity to the outer surface of the second side wall than the inner surface of the second side wall, the second connecting rod being essentially surrounded lengthwise by the second cylindrical spacer, the second cylindrical spacer having a diameter smaller than the height of the opposing horizontal slot and being rotatable with respect to the second connecting rod, whereby the second connecting rod serves to secure the second side panel to the second decor side panel and the second cylindrical spacer serves to help guide the drawer into and out of the frame by its rotational movement along the opposing horizontal slot when the drawer is pulled open or pushed closed.

3. The concealed case chest of drawers of claim 2 wherein the connecting means is further comprised of a first horizontal groove, a second horizontal groove, a lower edge of a first side panel, and a lower edge of a second side panel, the first horizontal groove having essentially the same length as the horizontal length of the first side wall, the first side panel being fixedly attached to the bottom panel of the drawer, the lower edge extending below the bottom panel and being slidably mounted in the first horizontal groove, the second horizontal groove having essentially the same length as the horizontal length of the second side wall, the second side panel being fixedly attached to the bottom panel of the drawer, the lower edge extending below the bottom panel and being slidably mounted in the second horizontal groove.

4. The concealed case chest of drawers of claim 3 further comprising a plurality of drawers slidably connected to the frame by a plurality of connecting means.

5. The concealed case chest of drawers of claim 3 further comprising a plurality of horizontal slots in both the first side wall and the second side wall, a plurality of essentially horizontally arranged connecting rods for both the first side wall and the second side wall, and a plurality of cylindrical spacers rotatably mounted on the connecting rods, all operatively connected to help guide the drawer into and out of the frame.

6. A concealed case chest of drawers comprising:

(a) a frame, the frame comprised of:

(i) a first side wall, the first side wall having an inner surface and an outer surface;

(ii) a second side wall, the second side wall having an inner surface and an outer surface, the inner surface of the second side wall facing the inner surface of the first side wall;

(iii) a top connected to the first side wall and the second side wall; and (iv) a back wall connected to the first side wall, the second side wall, and the top;

(b) a drawer comprised of:

(i) a bottom panel having a first edge and a second edge, the first edge being in close proximity to the inner surface of the first side wall and the second edge being in close proximity to the inner surface of the second side wall;

(ii) a front panel connected to the bottom panel, the front panel having a front, and a back, the front panel being longer than the portion of the bottom panel to which it is attached forming a first lip portion and a second lip portion, the first lip portion extending beyond both the first edge of the bottom panel and the first side wall, and the second lip portion extending beyond both the second edge of the bottom panel and the second side wall, the back of the front panel facing the back wall of the frame;

(iii) a first side panel fixedly attached to the back of the front panel and substantially perpendicular to the front panel, the first side panel extending horizontally between the inner surface of the first side wall and the inner surface of the second side wall and being closer to the inner surface of the first side wall;

(iv) a second side panel fixedly attached to the back of the front panel and substantially perpendicular to the front panel, the second side panel extending horizontally between the inner surface of the first side wall and the inner surface of the second side wall and being closer to the inner surface of the second side wall;

(v) a first decor side panel fixedly attached to the first lip portion of the front panel and substantially perpendicular to the front panel, the first decor panel extending horizontally in closer proximity to the outer surface of the first side wall than the inner surface of the first side wall; and (vi) a second decor side panel fixedly attached to the second lip portion of the front panel and substantially perpendicular to the front panel, the second decor panel extending horizontally in closer proximity to the outer surface of the second side wall than the inner surface of the second side wall; and (c) connecting means for slidably connecting the drawer to the frame, the connecting means being attached to and extending outwardly from the inner surfaces of the first side wall and the second side wall.

7. The concealed case chest of drawers of claim 6 wherein the connecting means is further comprised of a first horizontal groove, a second horizontal groove, a lower edge of the first side panel, and a lower edge of the second side panel, the lower edge of the first side panel extending below the bottom panel and the lower edge of the second side panel extending below the bottom panel, whereby the first horizontal groove engages the lower edge of the first side panel and the second horizontal groove engages the lower edge of the second side panel allowing the drawer to slide relative to the frame.

8. The concealed case chest of drawers of claim 6 wherein the first side wall and the second side wall are further comprised of a horizontal slot and an opposing horizontal slot, respectively, the first side wall's horizontal slot being substantially coextensive with the horizontal length of the first side wall and the second side wall's opposing horizontal slot being substantially coextensive with the horizontal length of the second side wall, the first side panel and the first decor side panel being attached with a first connecting rod, the first connecting rod having a first end and a second end, the first end attached to the first side panel and the second end attached to the first decor side panel, the connecting rod being essentially surrounded lengthwise by a first cylindrical spacer, the first cylindrical spacer having a diameter smaller than the height of the horizontal slot of the first side wall and being rotatable with respect to the first connecting rod, the second side panel and the second decor side panel are attached with a second connecting rod, the second connecting rod having a first end and a second end, the first end attached to the second side panel and the second end attached to the second decor side panel, the second connecting rod being essentially surrounded lengthwise by a second cylindrical spacer, the second cylindrical spacer having a diameter smaller than the height of the opposing horizontal slot of the second side wall and being rotatable with respect to the second connecting rod, whereby the first and second connecting rods serve to secure the first and second side panels to the first and second decor side panels, respectively, and the first and second spacers serve to help guide the drawer into and out of the frame by their rotational movement along the horizontal slot and opposing horizontal slot, respectively, when the drawer is pulled open or pushed closed.

9. The concealed case chest of drawers of claim 8 wherein the connecting means is further comprised of a first horizontal groove, a second horizontal groove, a lower edge of the first side panel, and a lower edge of the second side panel, the lower edge of the first side panel extending below the bottom panel and the lower edge of the second side panel extending below the bottom panel, whereby the first horizontal groove engages the lower edge of the first side panel and the second horizontal groove engages the lower edge of the second side panel allowing the drawer to slide relative to the frame.

10. The concealed case chest of drawers of claim 8 further comprising a plurality of horizontal slots in both the first side wall and the second side wall, a plurality of essentially horizontally arranged connecting rods for both the first side wall and the second side wall, and a plurality of cylindrical spacers rotatably mounted on the connecting rods, all operatively connected to help guide the drawer into and out of the frame.

11. A concealed case chest of drawers comprising:

(a) a frame, the frame comprised of:

(i) a first side wall, the first side wall having an inner surface and an outer surface;

(ii) a second side wall, the second side wall having an inner surface and an outer surface, the inner surface of the second side wall facing the inner surface of the first side wall;

(iii) a top connected to the first side wall and the second side wall; and (iv) a back wall connected to the first side wall, the second side wall, and the top;

(b) a drawer comprised of:

(i) a bottom panel having a first edge and a second edge, the first edge being in close proximity to the inner surface of the first side wall and the second edge being in close proximity to the inner surface of the second side wall;

(ii) a front panel connected to the bottom panel, the front panel having a front and a back, the back facing the back wall of the frame;

(iii) a first side panel fixedly attached to the back of the front panel and substantially perpendicular to the front panel, the side first panel extending horizontally between the inner surface of the first side wall and the inner surface of the second side wall and being closer to the inner surface of the first side wall;

(iv) a second side panel fixedly attached to the back of the front panel and substantially perpendicular to the front panel, the second side panel extending horizontally between the inner surface of the first side wall and the inner surface of the second side wall and being closer to the inner surface of the second side wall;

(v) a decor front panel fixedly attached to the front panel, the decor front panel having a first end and a second end and being longer than the front panel, the first end of the decor front panel extending beyond the first side wall and the second end of the decor front panel extending beyond the second side wall;

(vi) a first decor side panel fixedly attached to the first end of the decor front panel, the first decor panel extending horizontally in closer proximity to the outer surface of the first side wall than the inner surface of the first side wall and being substantially perpendicular to the front panel; and (vii) a second decor side panel fixedly attached to the second end of the decor front panel, the second decor panel extending horizontally in closer proximity to the outer surface of the second side wall than the inner surface of the second side wall and being substantially perpendicular to the front panel; and (c) connecting means for slidably connecting the drawer to the frame, the connecting means being attached to and extending outwardly from the inner surfaces of the first side wall and the second side wall.

12. The concealed case chest of drawers of claim 11 wherein the connecting means is further comprised of a first horizontal groove, a second horizontal groove, a lower edge of the first side panel, and a lower edge of the second side panel, the lower edge of the first side panel extending below the bottom panel and the lower edge of the second side panel extending below the bottom panel, whereby the first horizontal groove engages the lower edge of the first side panel and the second horizontal groove engages the lower edge of the second side panel allowing the drawer to slide relative to the frame.

13. The concealed case chest of drawers of claim 11 wherein the first side wall and the second side wall are further comprised of a horizontal slot and an opposing horizontal slot, respectively, the first side wall's horizontal slot being substantially coextensive with the horizontal length of the first side wall and the second side wall's opposing horizontal slot being substantially coextensive with the horizontal length of the second side wall, the first side panel and the first decor side panel being attached with a first connecting rod, the first connecting rod having a first end and a second end, the first end attached to the first side panel and the second end attached to the first decor side panel, the connecting rod being essentially surrounded lengthwise by a first cylindrical spacer, the first cylindrical spacer having a diameter smaller than the height of the horizontal slot of the first side wall and being rotatable with respect to the first connecting rod, the second side panel and the second decor side panel are attached with a second connecting rod, the second connecting rod having a first end and a second end, the first end attached to the second side panel and the second end attached to the second decor side panel, the second connecting rod being essentially surrounded lengthwise by a second cylindrical spacer, the second cylindrical spacer having a diameter smaller than the height of the opposing horizontal slot of the second side wall and being rotatable with respect to the second connecting rod, whereby the first and second connecting rods serve to secure the first and second side panels to the first and second decor side panels, respectively, and the first and second spacers serve to help guide the drawer into and out of the frame by their rotational movement along the horizontal slot and opposing horizontal slot, respectively, when the drawer is pulled open or pushed closed.

14. The concealed case chest of drawers of claim 13 wherein the connecting means is further comprised of a first horizontal groove, a second horizontal groove, a lower edge of the first side panel, and a lower edge of the second side panel, the lower edge of the first side panel extending below the bottom panel and the lower edge of the second side panel extending below the bottom panel, whereby the first horizontal groove engages the lower edge of the first side panel and the second horizontal groove engages the lower edge of the second side panel allowing the drawer to slide relative to the frame.

* * * * *